United States Patent [19]

Hinterreiter

[11] Patent Number: 4,986,442

[45] Date of Patent: Jan. 22, 1991

[54] TABLET DISPENSER

[76] Inventor: Ignaz Hinterreiter, Ramsauerstrasse 119, A-4020 Linz, Austria

[21] Appl. No.: 363,543

[22] Filed: Jun. 8, 1989

[30] Foreign Application Priority Data

Jun. 22, 1988 [AT] Austria ..... 1611/88

[51] Int. Cl.[5] ..... B65H 1/08

[52] U.S. Cl. ..... 221/229; 221/197; 221/198; 221/247

[58] Field of Search ..... 221/226, 227, 228, 229, 221/239, 279, 294, 191, 194, 195, 267, 224, 225, 232; 206/535, 536, 537

[56] References Cited

U.S. PATENT DOCUMENTS

| | | | |
|---|---|---|---|
| 2,274,238 | 2/1942 | Henderson 3rd et al. | 221/227 |
| 2,705,576 | 4/1955 | Amelio et al. | 221/226 |
| 2,853,206 | 9/1958 | Uxa | 221/229 |
| 3,410,455 | 11/1968 | Haas | 221/229 |
| 3,558,007 | 1/1971 | Seghezzi | 221/232 |
| 3,565,284 | 2/1971 | Hinterreiter | 221/229 |
| 4,126,248 | 11/1978 | House | 221/279 |
| 4,171,753 | 10/1979 | Vreede | 221/229 |
| 4,295,579 | 10/1981 | Haas | 221/197 |

*Primary Examiner*—Andres Kashnikow
*Assistant Examiner*—W. T. Waffner
*Attorney, Agent, or Firm*—Kurt Kelman

[57] ABSTRACT

The tablet dispenser comprises a drawer, which is adapted to be extracted into engagement with a stop from one end of a tubular protective housing and in its extracted position is adapted to be supplied with a columnlike stack of tablets. The tablets can be advanced as far as to an ejector, which is mounted on that portion of the drawer which protrudes from the protective housing. The ejector is operable to eject each tablet transversely to the longitudinal direction of the stack while the tablet is guided between spaced apart side guides. The side guides consist of clamping holders, which protrude beyond the end of the tubular protective housing and which receive one tablet at a time. Each tablet can be pushed between the clamping holders in that the drawer is raised. The drawer is provided near its bottom end with a foot for supporting the tablet stack. A tilting of the tablets in the housing is prevented by longitidinal guides.

9 Claims, 3 Drawing Sheets

TABLET DISPENSER

BACKGROUND OF THE INVENTION

1. Field of the Invention

This invention relates to a tablet dispenser comprising a drawer, which is adapted to be extracted into engagement with a stop from one end of a tubular protective housing and in its extracted position is adapted to be supplied with a columnlike stack of tablets and is adapted to be pushed into the housing together with the tablet stack, wherein the tablets of the inserted stack are slidably guided in the longitudinal direction of the stack by the drawer and by the protective housing and when the drawer has slidably been inserted each tablet is adapted to be ejected transversely to the longitudinal direction of the stack by means of an ejector, which is mounted on that end portion of the drawer which protrudes from the housing, and each tablet is guided between spaced apart side guides as the tablet is thus ejected by the ejector.

2. Description of the Prior Art

Such tablet dispensers are mainly used to dispense tablets which can be combined in a columnlike stack, i.e., tablets having a substantially cylindrical or prismatic peripheral surface. A main field of application for tablet dispensers are refreshing tablets and lozenges.

In known tablet dispensers of the kind described first hereinbefore the tablet stack is mainly guided in the drawer and the drawer is open only on the side on which the tablets are ejected so that the tablet stack can be inserted from that side when the drawer has been pulled out. A push rod which is longitudinally slidably guided in the drawer and in the housing is supported by a compression spring on the inner end of the drawer and as the empty drawer is extracted the push rod strikes against detent means provided adjacent to the open top end of the tubular protective housing so that said detent means prevent a further pulling out or pushing out of the push rod. The drawer must be extractable at least to the extent of the stack length.

Whether or not the drawer is filled, the compression spring tends to retract the drawer into the protective housing against a stop and thus has a dual function because when the drawer has been pushed in the compression spring will cause the push rod to advance the tablet stack toward the top end by the extent of one tablet height after a tablet has been dispensed.

The known tablet dispenser has various disadvantages. In the first place a stowage space of adequate length is required for the spring within the protective housing. Springs which have a complex shape and are relatively expensive must be provided and the three parts consisting of the protective housing, drawer and spring must be assembled in an exactly predetermined position. That assembling must virtually be effected by hand rather than by an automatic machine. The costs of the springs and of the assembling account for a major part of the manufacturing costs of such tablet dispensers and the dead space required to accommodate the spring also adds to the costs. Most tablet dispensers of that kind are definitely mass-produced. A basic disadvantage is due to the use of a spring, which has a relatively high initial stress when the drawer has been extracted. Manufacturing deviations of the tablet dispenser or damage effected during the use of the dispenser may have the result that the ejecting push rod is no longer satisfactorily retained at the end of the tubular protective housing but jumps out of the housing when the drawer has been extracted so that the push rod and also the spring will then be thrown out of the housing. As the spring is thrown out it may cause injuries and particularly injuries of the eye will be dangerous.

SUMMARY OF THE INVENTION

It is an object of the invention to provide a tablet dispenser which is similar in structure than the known dispensers and which requires no ejector spring and can easily be assembled and is reliable in operation.

That object is accomplished in accordance with the invention in that the side guides comprise two spaced apart clamping holders, which are connected to the protective housing and protrude above the top end of the tubular protective housing and are adapted to hold a single tablet between them, each tablet is adapted to be fed to side guides in that the drawer is extended, the drawer has a foot supporting the tablet stack at its bottom end, and longitudinal guides are provided, which extend preferably throughout the tablet receiving portion of the protective housing and through longitudinal openings of the drawer extend into positive or non-positive engagement with the tablets to prevent a tilting of the latter.

In the design embodying the invention, an ejecing push rod and a spring are no longer required. The tablets are caused to follow up simply in that the drawer is extracted so that the clamping holders engage the uppermost tablet of the stack. When the drawer has been pushed back, the ejector which is provided on the drawer and operates in the conventional manner is in the proper relative position so that it will be eject the tablet transversely to the longitudinal direction of the tablet stack as the ejector is actuated. When the tablet dispenser is held to have a vertical orientation, the required upward movement can be imparted to the drawer, e.g., with a thumb engaging an actuating projection whereas the remaining fingers of the same hand grasp the protective housing. The drawer may be designed to be so easily movable that when it is released it will slip back by gravity to its closing position. A rubber tape might be used to retract the drawer but this is by no means essential. After a short exercise the user of the tablet dispenser in accordance with the invention will be able to actuate the dispenser just as easily as a conventional dispenser. An advantage which is afforded resides in that a tablet stack can be more easily inserted because when the drawer has been extracted it need not be held in position against spring force. For transportation, the drawer may be held in position by cooperating detent means provided on the drawer and on the protective housing so that the drawer cannot be pushed out inadvertently.

In a preferred embodiment the clamping holders consist of tongues, which are integrally formed with the protective housing and are resiliently biased toward each other and have confronting side faces formed with grooves for retaining and guiding the tablet. Owing to that design a tablet which has entered the grooves will be locked against a continued pushing out in the longitudinal direction of the stack and such tablet can be pushed out by means of the ejector only transversely to the stack.

In a preferred embodiment the clamping holders are provided for basically rectangular tablets and on the side which is opposite to the ejector, said holders extend along the tablet only as far as to approximately the length center of the tablet and the protective housing has inwardly protruding wall portions, which continue the clamping holders and laterally guide the tablets at their rear portions and the drawer has wall portions which continue said wall portions of the housing and guide the tablets in the remaining part of their length, wherein the housing is formed with additional longitudinal guides, which serve to guide the tablets at their end faces and consist of cutting edges, ribs or rakes. Said longitudinal guides serve to prevent a tilting of the tablets of the stack. It must be taken into account that in the tablet dispenser in accordance with the invention the stack is under longitudinally acting initial stress only as a tablet is pushed into the range or the ejector, i.e., as the drawer is extended, but when the first tablet of a stack having a predetermined size has been extended the foot will yield as the drawer is pushed in. Various variants may be adopted in this respect. In one variant the stack is so loosely guided that it will always rest on the foot and will be lifted to the top end of the housing by the foot portion as the latter is lifted. According to a further variant a clamping holder or a backslip preventer for the tablets of the stack is provided, optionally in combination of spreading shingles But it is preferred to guide the tablets in the manner described hereinbefore by wall portions of the drawer and the housing on the longitudinal sides of the tablets and by knife edges and rakelike longitudinal guides provided in the housing and guiding the tablets at their end faces. In that case the tablets may inherently be provided with indentations or grooves and in said indentations or grooves may additionally be guided on said knife edges or rakes. It will be simpler, however, if the distance between the mutually oppositely attached knife edges or rakes is slightly smaller than the length of each tablet so that said knife edges or rakes will form guiding grooves in the tablets of the stack. Correspondingly shallow grooves may be formed virtually in any tablet and will not result in a substantially abrasion and/or a breakage of the tablets.

The assembling operation can be simplified in that the foot for supporting the tablet stack and a guiding member which is provided at the inner end of the drawer and is spaced from the foot portion are adapted to be inserted into the tubular protective housing through the top opening of the latter and are locked by the clamping holders against being extracted out of the housing. The foot and the guiding member may be interconnected so that they will be supported in the protective housing in a sufficient length even when the drawer has been extracted as far as possible. But the provision of the foot and the guiding member as separate parts will result in a saving of material and will facilitate the insertion of the drawer into the protective housing.

DETAILED DESCRIPTION OF THE PREFERRED EMBODIMENT

Figure 1:
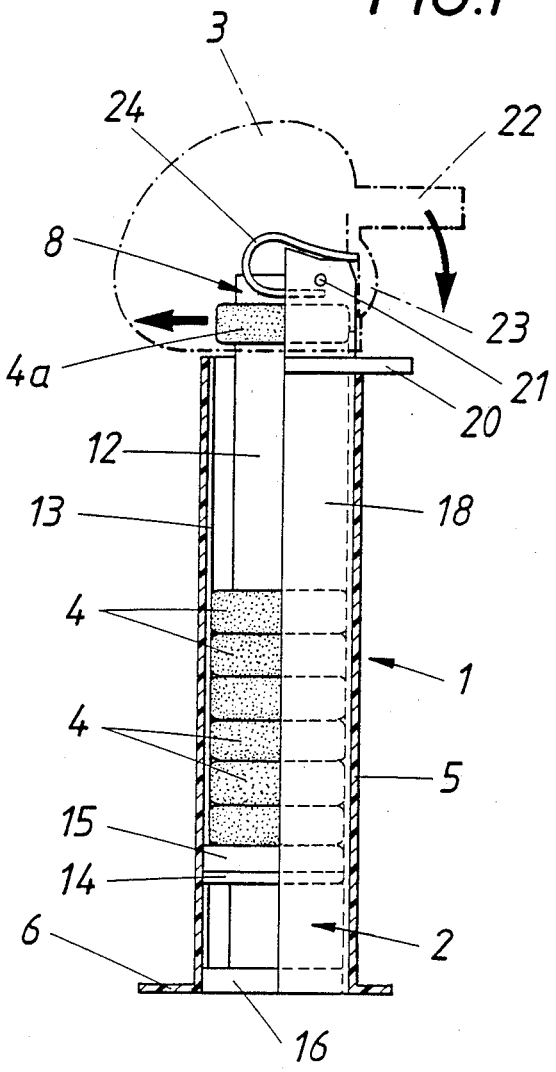
FIG. 1 shows a tablet dispenser embodying the invention comprising an inserted tablet stack in position for use; the protective housing is shown in longitudinal section and the drawer in side elevation and only the contours of a tablet ejector are indicated in phantom.
Figure 2:
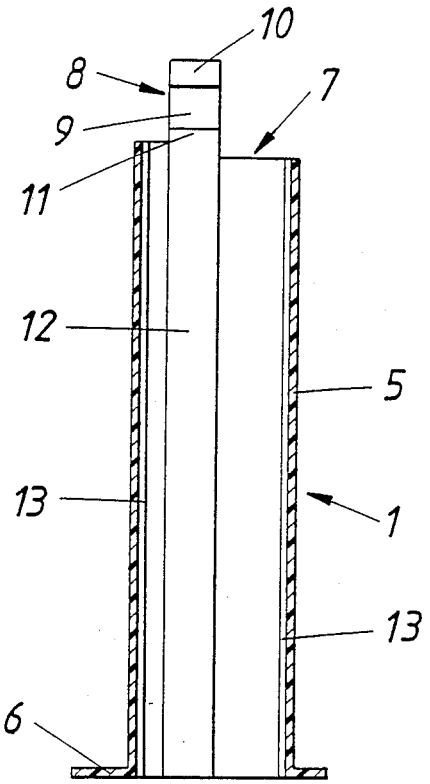
FIGS. 2 and 3 are longitudinal sectional views showing the housing alone.
Figure 3:
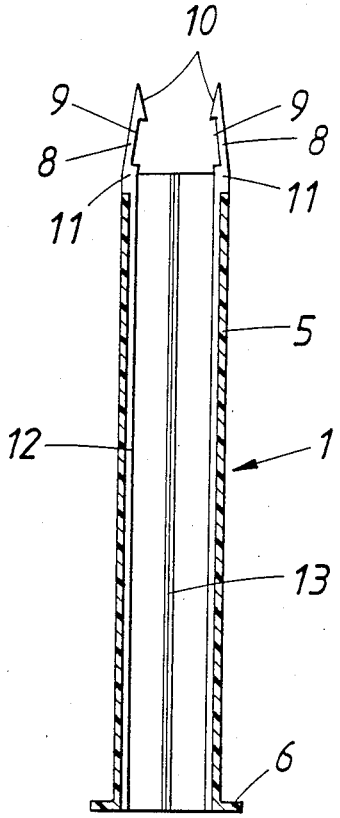
Figure 4:
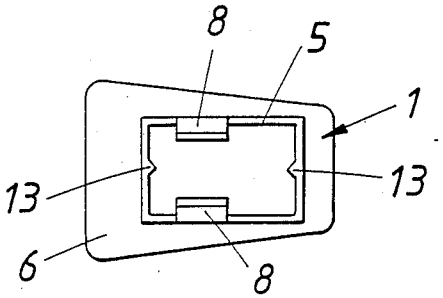
FIG. 4 is a top plan view showing the housing.
Figure 5:
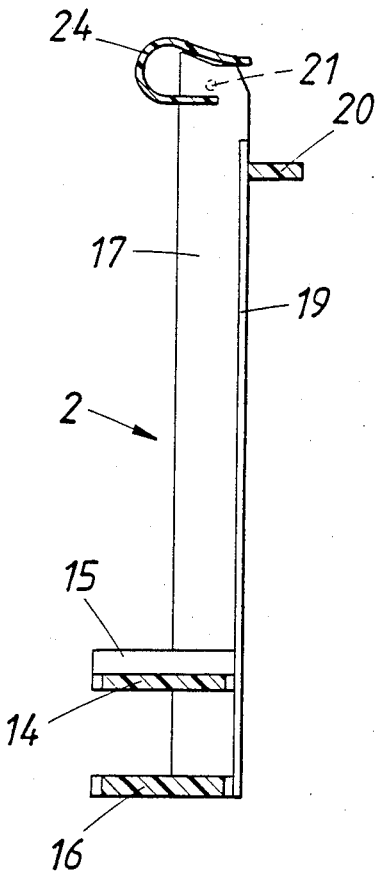
FIG. 5 is a longitudinal sectional view showing the drawer.
Figure 6:
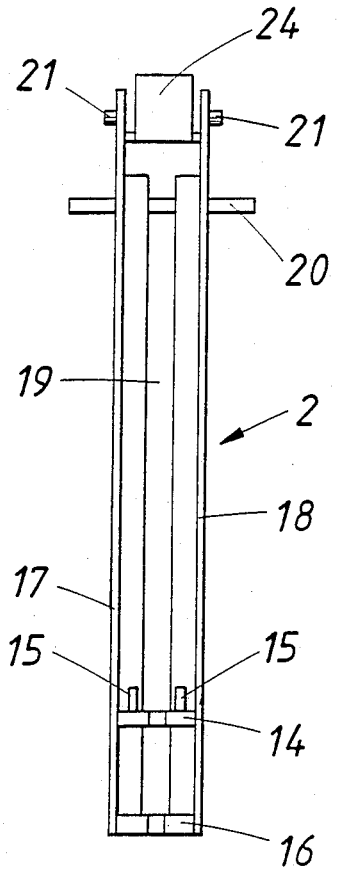
FIG. 6 is a side elevation showing the drawer.
Figure 7:
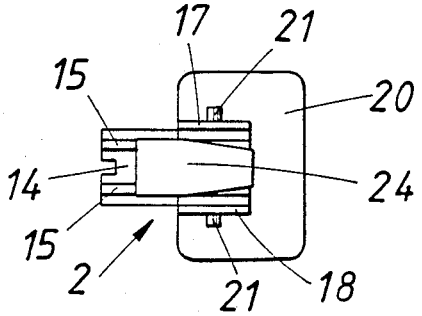
FIG. 7 is a top plan view showing the drawer.

Further details and advantages of the invention will become apparent from the Following description of an illustrative embodiment of the invention shown on the drawing.

The illustrated tablet dispenser consists of three main parts, namely, a protective housing 1, a drawer 2, and an ejector 3, of which only the contours are indicated in phantom. The tablet dispenser 1 to 3 is intended to receive rectangular prismatic tablets 4, 4*a*. The protective housing 1 comprises a rectangular tubular shell 5, which is provided at its bottom end with a flange 6, which may be used to support the dispenser. Adjacent to the ejector 3 the tubular shell has a top end 7, which is integrally formed on two mutually opposite sides with protruding spring tongues 8, which on their confronting sides are formed with guiding grooves 9 for guiding a tablet 4*a* at its longitudinal edges. The grooves have guiding surfaces 10, 11, which are inclined to the side faces of the groove. The guiding surfaces 10 are intended to facilitate the introduction of a foot 14 of the drawer 2 and of the entire tablet stack. The foot 14 will be described hereinafter. When the uppermost tablet 4*a* is disposed in the grooves 9, which constitute longitudinal guides, the guiding surfaces 11 will hold back the next following tablet 4 of the stack. In the protective housing 1, the tongues 8 are continued by re-entrant wall portions 12, which protrude toward each other and serve to guide the tablets 4 at the left-hand forward half of their longitudinal sides. Rake-like longitudinal guides 13 for guiding the tablets 4 at their end faces are integrally formed on mutually opposite wall portions of the tubular shell and are spaced a distance apart which is slightly smaller than the length of a tablet 4 so that the longitudinal guides 13 form grooves in the tablets of a stack which has been inserted.

The drawer 2 comprises a foot 14, which fits into the wall that is defined by the shell 5 of the protective housing 5. The foot 14 is formed on its upper surface with ribs 15 for supporting the tablet stack. At a distance below the foot 14, the drawer 2 is provided at its inner end with a guiding member 16. The foot 14 and the guiding member 16 are supplemented by wall portions 17, 18 to form the drawer body. When the drawer 2 has been inserted, the wall portions 17 continue the wall portions 12 of the housing 1. The wall portions 18 define between them a longitudinal slot 19, through which one of the rakes 13 can extend into sliding contact with the tablets 4. The spring tongues 8 are spread apart as the guiding member 16 and the foot 14 are inserted into the well of the protecting housing 1 and are force through between the inwardly protruding detent surfaces 11. Once the drawer has been inserted, the detent surfaces 11 prevent the drawer from being entirely extracted out of the protective housing 1.

The wall portions 17 are upwardly extended beyond the drawer body proper and beyond a flangelike handle 20 of the drawer 2 and said extensions are integrally formed with pivot pins 21 for for pivotally mounting the plastic ejector 3. When the ejector 3 is in its position of rest it covers the protective housing 1 and the drawer 2 at the top. The ejector 3 is provided at one end with an actuating handle 22 and at the other end with an ejector claw 23 by which a tablet held in the grooves 9 can be ejected by a pivotal movement of the ejector 3. A plastic leaf spring 24 is mounted between the wall portions 17 and serves to return the ejector 3 after it has been actuated.

When the drawer has been pulled out of the protective housing 1 as far as to the detent surfaces 11, the tablet dispenser is filled in that a stack of tablets 4 is inserted into the extracted drawer and is supported on the foot 15 and the wall portions 17, 18. The drawer 2 is then pushed into the protective housing 1 to assume the position shown in FIG. 1. The drawer 2 is pulled out until the uppermost tablet 4*a* of the tablet stack snaps into the longitudinal guide that is constituted by the grooves 9. Thereafter the drawer is pushed back to the position shown in FIG. 1. The ejector 3 can then be actuated so that the tablet 4*a* is ejected by the lever 22. A tilting of the tablets 4 is prevented by the wall portion 12, 17, 18 and the guiding rakes 13 regardless of the position to which the drawer has been pushed.

I claim:

1. In a tablet dispenser comprising a tubular protective housing having a top end and provided at said top end with inwardly protruding detent means, a drawer, which is axially slidably mounted in said housing and protrudes from said housing at said top end and is adapted to be upwardly extracted from said housing to a top position, in which said drawer engages said detent means, a columnlike stack of tablets, which is contained in said drawer and comprises a plurality of tablets, each of which is in sliding contact with said drawer and said protective housing, said drawer being adapted to receive such a stack of tablets when said drawer is in said top position, two mutually opposite side guides, which are mounted on said housing and extend above said top end thereof and are adapted to receive one of said tablets from said stack and to guide said one tablet transversely to the axis of said drawer, and an ejector, which is movably mounted in said drawer outside said protective housing and is operable to eject said one tablet on one side of said drawer transversely to the axis of said drawer when said one tablet is disposed between said side guides, the improvement residing in that said side guides comprise laterally spaced apart clamping holders, which are connected to said housing and extend above said top end thereof and hold said one tablet between them, said drawer has a bottom end disposed in said housing and near said bottom end is provided with a foot, which supports said stack of tablets, and after the ejection of said one tablet said drawer is adapted to be raised in said housing to move the uppermost tablet of said stack to a position between said clamping holders.

2. The improvement set forth in claim 1, wherein said drawer is formed with longitudinally extending, continuous openings and said housing is provided with longitudinal guides, which extend through said longitudinal openings and engage said stack of tablets to prevent a tilting of said tablets in said drawer.

3. The improvement set forth in claim 2, wherein said longitudinal guides are in positive engagement with said tablets.

4. The improvement set forth in claim 2, wherein said longitudinal guides engage all tablets of said stack in said drawer.

5. The improvement set forth in claim 1 as applied to a tablet dispenser in which said tablets are basically rectangular, wherein said one tablet has a forward portion extending between said clamping holders only to approximately the length center of said uppermost tablet, and a rear portion laterally protruding from said clamping holders toward the other side of said drawer, said housing comprises housing wall portions which laterally guide said rear portion of said one tablet and corresponding rear portions of the tablets of said stack, said drawer comprises drawer wall portions which extend from said housing wall portions and guide said tablets of said stack at side portions other than said rear portions, and said housing is provided with additional longitudinal guides in sliding contact with opposite end faces of said tablets.

6. The improvement set forth in claim 5, wherein said additional longitudinal guides comprise rakes.

7. The improvement set forth in claim 1, wherein said clamping holders comprise resilient tongues, which are integrally formed with said housing and resiliently biased toward each other and have confronting sides, which are formed with grooves for retaining and guiding said one tablet.

8. The improvement set forth in claim 1, wherein a guide member is mounted in said drawer at said bottom end of said drawer at a distance below said foot, said guide member and said foot have been inserted into said drawer through said top end of said protective housing, and said clamping holders are arranged to prevent an extraction of said foot and said guide member out of said protective housing.

9. The improvement set forth in claim 5, wherein said additional longitudinal guides are spaced a distance apart which is smaller than the length of each tablet whereby the additional longitudinal guides form grooves in the end faces of said tablets.

* * * * *